US007634830B2

(12) United States Patent
Ryan

(10) Patent No.: US 7,634,830 B2
(45) Date of Patent: Dec. 22, 2009

(54) FIREFIGHTER'S ESCAPE IMPLEMENT

(76) Inventor: Gregory F. Ryan, 620 New St., Rivervale, NJ (US) 07675

( * ) Notice: Subject to any disclaimer, the term of this patent is extended or adjusted under 35 U.S.C. 154(b) by 277 days.

(21) Appl. No.: 11/450,803

(22) Filed: Jun. 8, 2006

(65) Prior Publication Data

US 2007/0283503 A1 Dec. 13, 2007

(51) Int. Cl.
*B66F 15/00* (2006.01)

(52) U.S. Cl. ..... 7/166; 7/138; 7/145; 7/146

(58) Field of Classification Search ..... 7/138, 7/145, 146, 166
See application file for complete search history.

(56) References Cited

U.S. PATENT DOCUMENTS 3,219,316 A * 11/1965 Fried ..... 254/131
5,339,527 A 8/1994 Clemens, Jr.
5,428,853 A * 7/1995 Menke et al. ..... 7/138
6,233,877 B1 5/2001 Monroe
6,367,107 B1 * 4/2002 Corsini ..... 7/143
6,671,913 B2 * 1/2004 Wozniak ..... 7/138
2002/0189898 A1 12/2002 Campbell
2004/0261188 A1 12/2004 Mathis

* cited by examiner

*Primary Examiner*—Joseph J Hail, III
*Assistant Examiner*—Shantese McDonald
(74) *Attorney, Agent, or Firm*—Arthur Jacob

(57) ABSTRACT

An escape implement assists a firefighter in exiting a burning building through a window by securing an elongate bar extending longitudinally and juxtaposed with a corner of the window. The bar is secured in place with sharp-ended members projecting from the bar in the same lateral directions for piercing the wall to anchor the bar to the wall so as to span the corner, with an intermediate portion of the bar placed relative to the corner for enabling the attachment of an escape line to the intermediate portion of the bar. The escape line is attached to a looped member coupled with the bar for swiveling about the longitudinal direction so as to avoid the transmission of torque from the escape line to the bar which otherwise could tend to dislodge the sharp-ended members from the wall.

14 Claims, 3 Drawing Sheets

FIREFIGHTER'S ESCAPE IMPLEMENT

The present invention relates generally to implements carried by firefighters to assist in fighting fires in buildings and pertains, more specifically, to a firefighter's escape implement for facilitating exiting a burning building through a window, should such an escape become necessary.

Firefighters ordinarily carry into a fire a multitude of tools and equipment for dealing with the many and varied situations with which a firefighter can be confronted during fighting a fire. In order to minimize the bulk and weight of a firefighter's burden, implements have been designed to enable the use of a single implement in performing a multitude of different tasks.

One such implement which has been adopted widely by fire departments throughout the world was designed in 1948 by Deputy Chief Hugh Halligan of the fire department of New York City and was introduced to that department in 1950. The "Halligan" tool is exceptionally versatile, providing a firefighter with a single implement which can assist in forcing open doors, windows and locks, as well as in breaking through walls so as to effectively track down and eradicate a particular fire. Thus, the Halligan tool incorporates a point for forcing open locks, hasps and related hardware, an adz for breaking doors, windows and the like, as well as for opening walls to seek out fires in buildings, and a fork to facilitate breaking open closures, hatches, doors and the like to gain entry into a burning building, all combined in a single tool easily carried by a firefighter.

A growing number of incidents where firefighters have been lost as a result of being unable to escape a burning building has prompted a search for a personal escape device that could be carried into a fire by a firefighter without adding significantly to the bulk and weight of the firefighter's existing burden, yet will provide the firefighter with the ability to exit a burning building with greater ease and safety. The present invention addresses that need.

As such, the present invention attains several objects and advantages, some of which are summarized as follows: Provides firefighters with a simple, compact and highly effective tool which assists in the firefighter's ability to escape from a burning building; increases the versatility of an already widely accepted tool currently carried by firefighters throughout the world; makes use of existing structure in a building to enable a quick and decisive deployment of equipment for safely exiting a burning building; does not add significantly to the bulk and weight of tools and equipment ordinarily carried by firefighters in fighting fires; is constructed in a form generally familiar to firefighters, requiring little added training in order to enable reliable, safe and effective use in escaping from a burning building; provides an implement of relatively simple and rugged construction capable of exemplary performance over an extended service life.

The above objects and advantages, as well as further objects and advantages, are attained by the present invention which is described briefly as an escape implement for assisting a firefighter in exiting a burning building through a window, the window being placed in a wall of the building and having a corner at an intersection between adjacent window frame members, the escape implement comprising: an elongate bar extending in a longitudinal direction and having longitudinally spaced apart first and second ends; sharp-ended members affixed to and projecting from the bar at longitudinally spaced apart locations along the bar adjacent each end of the bar, the sharp-ended members extending in the same lateral directions and lying in a common plane containing the longitudinal direction; a looped member coupled with the bar at a fixed location intermediate the sharp-ended members, the looped member being dimensioned and configured for suspending an escape line therefrom; the longitudinally spaced apart locations being placed on the bar such that upon anchoring the sharp-ended members within the wall with each sharp-ended member placed adjacent a corresponding adjacent window frame member, the bar will be juxtaposed with the corner of the window to locate the looped member in juxtaposition with the corner for suspending the escape line from the window to outside the burning building.

In addition, the present invention provides a method for assisting a firefighter in exiting a burning building through a window, the window being placed in a wall of the building, the wall having an inside and an outside, and the window having a corner at an intersection between adjacent window frame members, the method comprising: securing an elongate bar to the inside of the wall in a longitudinal direction extending oblique relative to the adjacent window frame members to place the bar along a diagonal direction relative to the corner, with an intermediate portion of the bar juxtaposed with the corner; attaching a safety line to the intermediate portion of the bar; extending the safety line through the window to extend along the outside of the wall; and exiting the building through the window to escape along the safety line extending along the outside of the wall.

The present invention will be understood more fully, while still further objects and advantages will become apparent, in the following detailed description of preferred embodiments of the invention illustrated in the accompanying drawing, in which.

Figure 1:
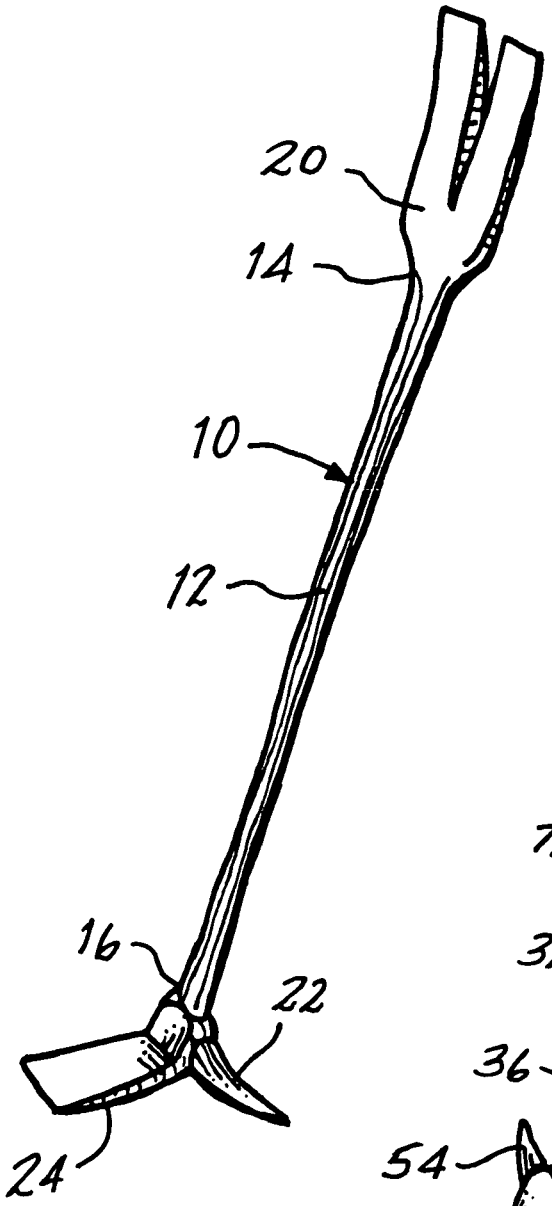
PRIOR ART FIG. 1
FIG. 1 is a pictorial view of a conventional Halligan tool.
Figure 2:
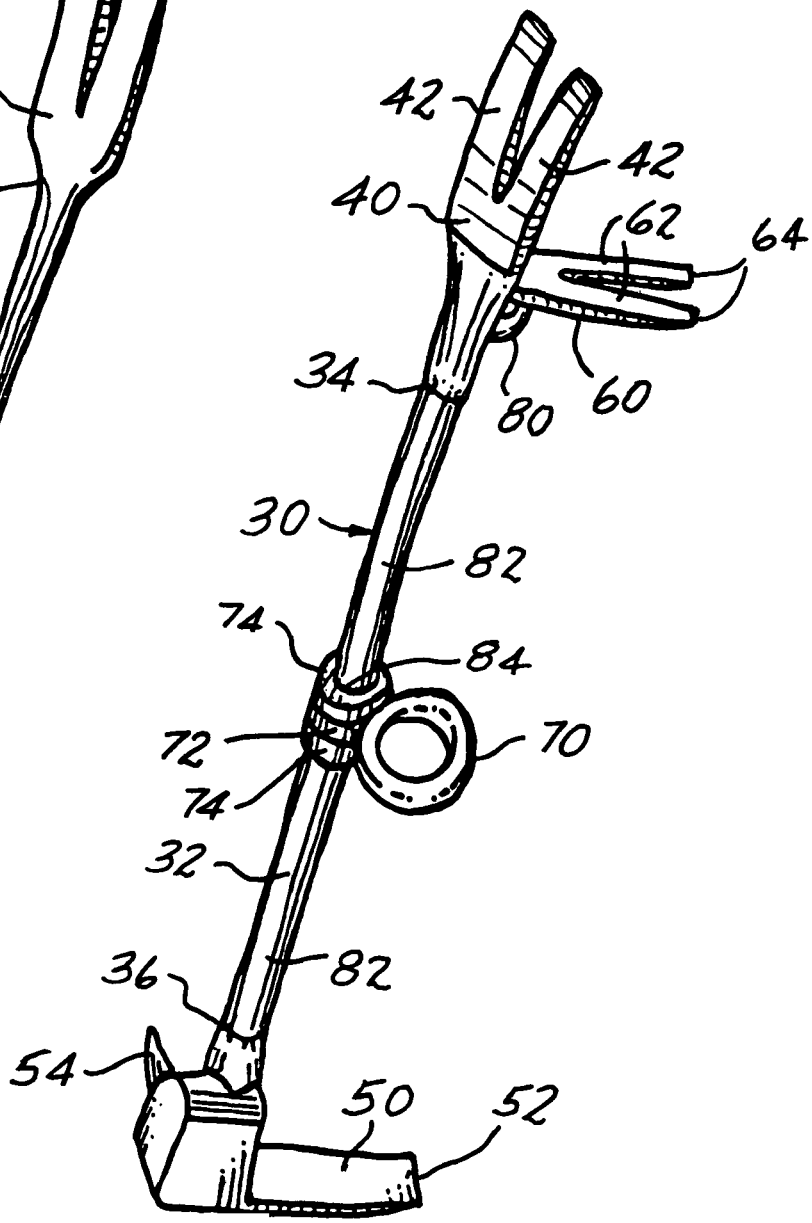
FIG. 2 is a pictorial view of an implement constructed in accordance with the present invention.

Referring now to the drawing, and especially to FIG. 1 thereof, a now conventional "Halligan" tool is shown at 10 and is seen to include an elongate bar 12 extending longitudinally between opposite first and second ends 14 and 16, respectively. At the first end 14, tool 10 includes a fork 20 projecting from the bar 12 in a longitudinal direction. At the second end 16, tool 10 includes a point 22 projecting from the bar 12 in a lateral direction, normal to the longitudinal direction, and an adz 24 projecting from the bar 12 in a lateral direction mutually perpendicular to the longitudinal and lateral directions in which the bar 12 and the point 22 extend. The Halligan tool 10 is a compact and versatile tool readily carried by firefighters who use the tool 10 for various operations during fighting a fire. To that end, fork 20 is available for breaking or prying open closures, hatches, doors and the like to gain entry into a burning building, point 22 usually is used for forcing open locks, hasps and related hardware, and adz 24 eases the breaking of doors, windows and the like, as well as for opening walls to seek out fires in buildings. Thus, the Halligan tool 10 provides a firefighter with a single tool easily carried into a burning building for assisting in the performance of a variety of operations necessary to fight a fire.

The present invention provides all of the benefits and capabilities of the Halligan tool, and adds the ability to use a single, easily-carried compact tool as an implement readily deployed for assisting a firefighter in exiting a burning building with safety and effectiveness, should escape become necessary.

Turning now to FIGS. 2 through 6, an implement constructed in accordance with the present invention is shown at 30 and is seen to include an elongate bar 32 extending in a longitudinal direction and having first and second longitudinally spaced apart ends 34 and 36, respectively. In a manner similar to the above-described Halligan tool, bar 32 is provided, at first end 34, with an entry tool in the form of a fork 40 affixed to end 34 and having two tines 42 extending in a generally longitudinal direction, usually used for prying open doors, windows and other access openings. A sharp-ended member in the form of an adz 50 is affixed to and projects from the second end 36 of the bar 32 in a generally lateral direction, preferably essentially normal to the longitudinal direction, and terminates in a sharp edge 52 which extends transverse to the longitudinal and lateral directions, the adz 50 being available for breaking open doors and windows to gain entry to a burning building, and breaking open walls to gain access to a fire within the walls. In addition, at the same end 36, a point 54 is affixed to and projects from the bar 32 in a generally lateral direction, preferably mutually perpendicular to the longitudinal direction, and to the lateral direction in which the adz 50 projects, the point 54 being available for breaking open locks, hasps and similar hardware in order to gain entry into the burning building.

Added to implement 30 is another sharp-ended member in the form of an anchoring member 60, also affixed to bar 32 adjacent end 34 and projecting in a lateral direction from the bar 32. Anchoring member 60 is generally wedge-shaped and is bifurcated to establish two tines 62 spaced apart in a transverse direction, each tine 62 terminating in a sharp edge 64 extending in the same transverse direction.

A looped member in the form of a ring 70 is placed on bar 32 at a fixed location intermediate the ends 34 and 36 of bar 32 and, consequently, intermediate the adz 50 and the anchoring member 60. Ring 70 is secured to a bushing 72 which, in turn, is coupled for swiveling upon the bar 32 about the longitudinal direction. A retainer 74 is located at either side of the bushing 72, affixed to the bar 32 so that bushing 72 and ring 70 are confined longitudinally to the intermediate location, placed essentially centrally between ends 34 and 36 and, consequently, essentially midway between adz 50 and anchoring member 60. A supplemental loop 80 is secured adjacent end 36, between the bar 32 and the anchoring member 60, and handgrips 82 are provided along the bar 32, adjacent each end 34 and 36, with an intermediate portion 84 of bar 32 located between the handgrips 82, all for purposes to be set forth in detail below.

Figure 7:
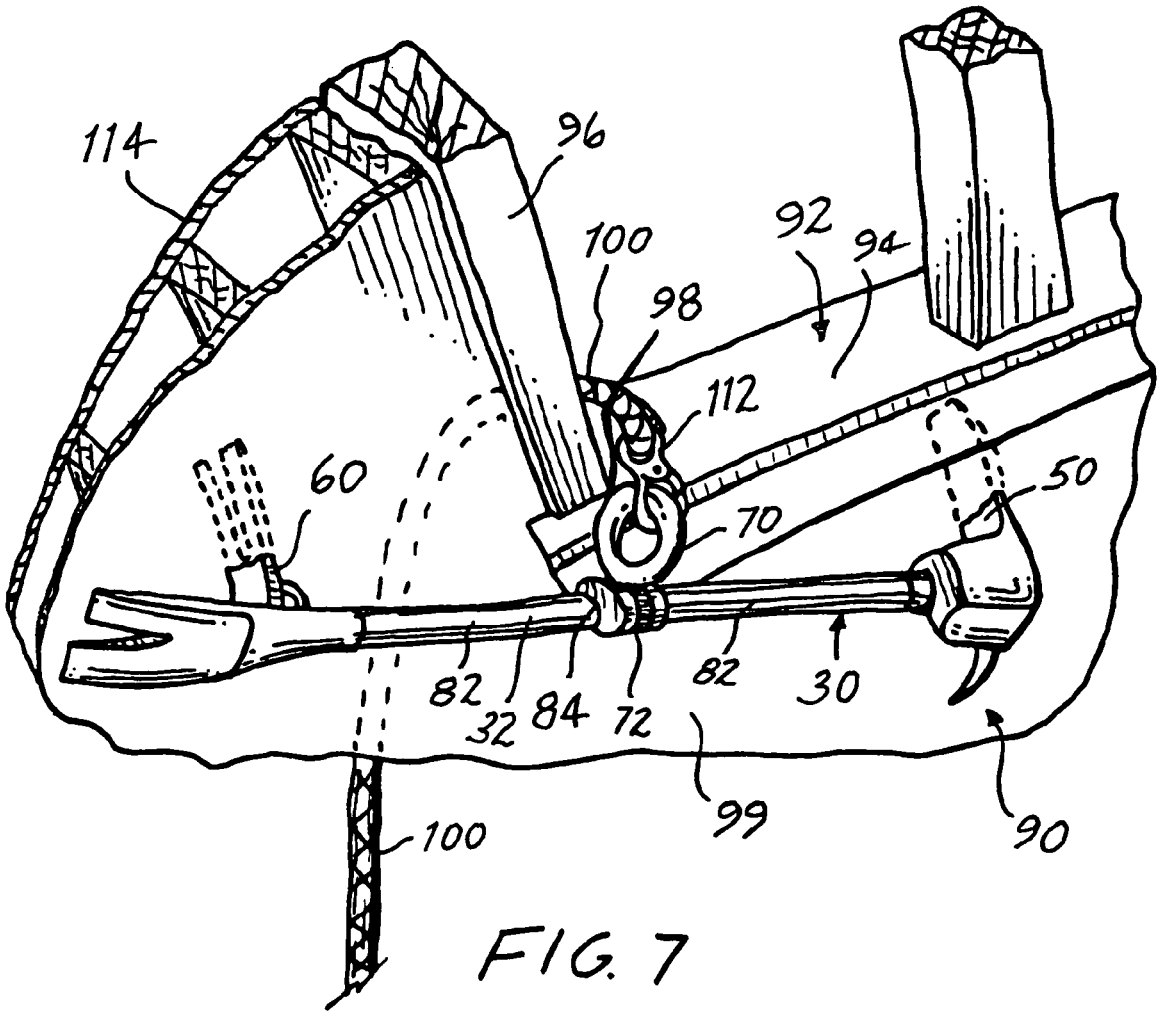
FIG. 7 is a pictorial illustration of a method of use of the implement in accordance with the present invention.

Referring now to FIG. 7, as well as to FIGS. 2 through 6, a wall of a burning building is depicted at 90 and is seen to include a window 92 having adjacent window frame members 94 and 96 intersecting at a corner 98. Should it become necessary for a firefighter to escape the burning building, window 92 is made ready to serve as a safe exit through the use of implement 30. Thus, bar 32 is deployed readily, and then is grasped along the handgrips 82 and oriented in a direction oblique to the directions of intersecting window frame members 94 and 96, along a diagonal direction extending adjacent corner 98, placing the adz 50 adjacent one of the window frame members, here shown as window frame member 94, and placing the anchoring member 60 adjacent the other of the window frame members, illustrated as window frame member 96. Ring 70 is juxtaposed with corner 98, and the adz 50 and the anchoring member 60 are driven forcefully into wall 90, as by swinging bar 32 in a lateral direction toward the wall 90 so that the sharp edges 52 and 64 penetrate inside 99 of wall 90, to secure implement 30 in place, essentially straddling corner 98, with intermediate portion 84 of bar 32 juxtaposed with corner 98, as shown. With the implement 30 secured to wall 90, by virtue of the penetration of adz 50 and anchoring member 60 into wall 90, and with ring 70 juxtaposed with corner 98, a safety line 100 is connected to ring 70 by means of a snap link 112 secured to safety line 100 and is lowered out of the window 92, along outside 114 of wall 90. Line 100 now is available to the firefighter for climbing out of the window 92 and down the exterior of wall 90 to safety.

Figure 4:
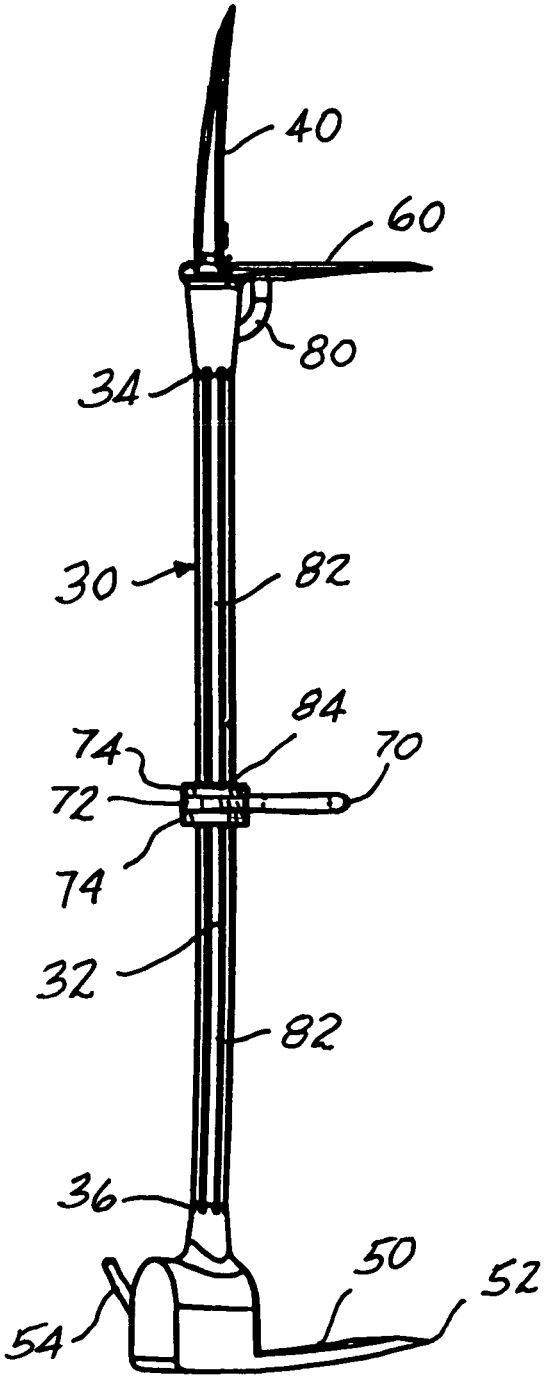
FIG. 4 is a side elevational view of the implement.
Figure 3:
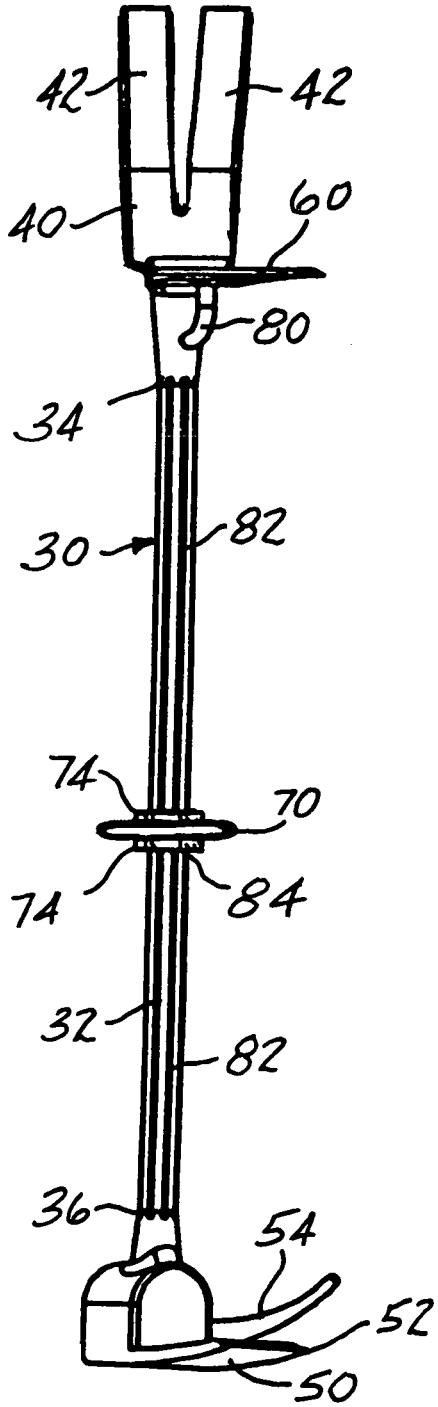
FIG. 3 is a top plan view of the implement.
Figure 5:
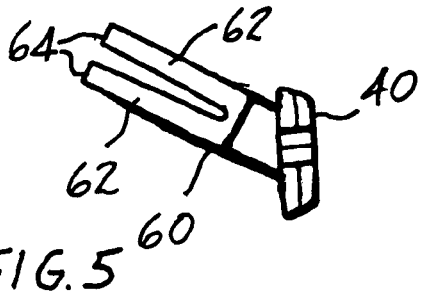
FIG. 5 is an end elevational view of one end of the implement.
Figure 6:
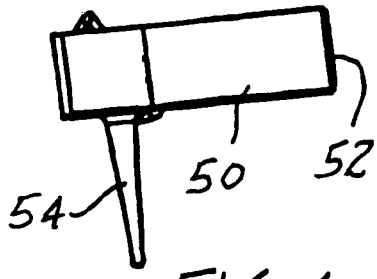
FIG. 6 is an end elevational view of the other end of the implement.

Since ring 70 is free to swivel upon bar 32, about the longitudinal direction, by virtue of bushing 72, no torque is transmitted from line 100 through ring 70 and bushing 72 to bar 32, which torque otherwise could tend to dislodge adz 50 and anchoring member 60, and bar 32 will remain firmly secured to wall 90 by adz 50 and anchoring member 60, both of which project from bar 32 in the same lateral directions in a common plane, which is the plane of the paper in FIG. 4, within which common plane lies the longitudinal direction of bar 32. Placement of the implement 30 in juxtaposition with corner 98, generally straddling corner 98, assures that bar 32 will remain well secured during the firefighter's exit and escape. As with most openings in a building wall, the corner 98 provided by window 92 is reinforced with frame members 94 and 96 which intersect at corner 98, thereby establishing a structurally sound anchoring location for securing bar 32 in place. Accordingly, the term "window" is used herein to denote any window-like opening in a building wall which makes available a reinforced corner for the juxtaposition of bar 32 to secure implement 30 in place for a safe escape.

Supplemental loop 80 enables implement 30 to be attached to a line (not shown), similar to the manner in which line 100 is attached to ring 70, to enable a firefighter to swing implement 30 freely through glass windows and doors, as firefighters are wont to do in order to open a vent, gain entry into a burning building, or to open an exit from a burning building.

It will be seen that the present invention attains all of the objects and advantages summarized above, namely: Provides firefighters with a simple, compact and highly effective tool which assists in the firefighter's ability to escape from a burning building; increases the versatility of an already widely accepted tool currently carried by firefighters throughout the world; makes use of existing structure in a building to enable a quick and decisive deployment of equipment for safely exiting a burning building; does not add significantly to the bulk and weight of tools and equipment ordinarily carried by firefighters in fighting fires; is constructed in a form generally familiar to firefighters, requiring little added training in order to enable reliable, safe and effective use in escaping from a burning building; provides an implement of relatively simple and rugged construction capable of exemplary performance over an extended service life.

It is to be understood that the above detailed description of preferred embodiments of the invention are provided by way of example only. Various details of design, construction and procedure may be modified without departing from the true spirit and scope of the invention, as set forth in the appended claims.

The embodiments of the invention in which an exclusive property or privilege is claimed are defined as follows:

1. An escape implement for assisting a firefighter in exiting a burning building through a window, the window being placed in a wall of the building and having a corner at an intersection between adjacent window frame members, the escape implement comprising:

an elongate bar extending in a longitudinal direction and having longitudinally spaced apart first and second ends;

sharp-ended members affixed to and projecting from the bar at longitudinally spaced apart locations along the bar adjacent each end of the bar, the sharp-ended members extending in the same lateral directions and lying in a common plane containing the longitudinal direction;

a looped member coupled with the bar at a fixed location intermediate the sharp-ended members, the looped member being dimensioned and configured for suspending an escape line therefrom, the looped member comprising a ring coupled with the bar for swiveling about the longitudinal direction;

the longitudinally spaced apart locations being placed on the bar such that upon anchoring the sharp-ended members within the wall with each sharp-ended member placed adjacent a corresponding adjacent window frame member, the bar will be juxtaposed with the corner of the window to locate the looped member in juxtaposition with the corner for suspending the escape line from the window to outside the burning building.

2. The escape implement of claim 1 including retainers confining the looped member to the fixed location.

3. The escape implement of claim 2 wherein the fixed location is placed essentially centrally between the first and second ends of the bar.

4. The escape implement of claim 1 wherein the sharp-ended members include a first sharp-ended member adjacent the first end, the first sharp-ended member being bifurcated and having sharp-edged tines spaced apart in a direction transverse to the longitudinal direction.

5. The escape implement of claim 1 wherein the sharp-ended members include a second sharp-ended member adjacent the second end, the second sharp-ended member comprising an adz.

6. The escape implement of claim 5 wherein the adz includes a sharp edge oriented transverse to the longitudinal direction.

7. The escape implement of claim 1 wherein the sharp-ended members include a first sharp-ended member adjacent the first end, the first sharp-ended member being bifurcated and having sharp-edged tines spaced apart in a direction transverse to the longitudinal direction, and a second sharp-ended member adjacent the second end, the second sharp-ended member comprising an adz having a sharp edge oriented transverse to the longitudinal direction.

8. The escape implement of claim 1 including a fork adjacent the first end of the bar, the fork extending in the longitudinal direction.

9. The escape implement of claim 1 including a point adjacent the second end of the bar, the point projecting essentially normal to the common plane.

10. The escape implement of claim 1 including a fork adjacent the first end of the bar, the fork extending in the longitudinal direction, and a point adjacent the second end of the bar, the point projecting essentially normal to the common plane.

11. An escape implement for assisting a firefighter in exiting a burning building through a window, the window being placed in a wall of the building and having a corner at an intersection between adjacent window frame members, the escape implement comprising:

an elongate bar extending in a longitudinal direction and having longitudinally spaced apart first and second ends;

sharp-ended members affixed to and projecting from the bar at longitudinally spaced apart locations along the bar adjacent each end of the bar, the sharp-ended members extending in the same lateral directions and lying in a common plane containing the longitudinal direction, the sharp-ended members include a first sharp-ended member adjacent the first end, the first sharp-ended member being bifurcated and having sharp-edged tines spaced apart in a direction transverse to the longitudinal direction, and a second sharp-ended member adjacent the second end, the second sharp-ended member comprising an adz having a sharp edge oriented transverse to the longitudinal direction;

a looped member coupled with the bar at a fixed location intermediate the sharp-ended members, the looped member being dimensioned and configured for suspending an escape line therefrom, the looped member comprising a ring coupled with the bar for swiveling about the longitudinal direction;

the longitudinally spaced apart locations being placed on the bar such that upon anchoring the sharp-ended members within the wall with each sharp-ended member placed adjacent a corresponding adjacent window frame member, the bar will be juxtaposed with the corner of the window to locate the looped member in juxtaposition with the corner for suspending the escape line from the window to outside the burning building.

12. The escape implement of claim 11 including retainers confining the looped member to the fixed location.

13. The escape implement of claim 12 wherein the fixed location is placed essentially centrally between the first and second ends of the bar.

14. An escape implement for assisting a firefighter in exiting a burning building through a window, the window being placed in a wall of the building and having a corner at an intersection between adjacent window frame members, the escape implement comprising:

an elongate bar extending in a longitudinal direction and having longitudinally spaced apart first and second ends;

sharp-ended members affixed to and projecting from the bar at longitudinally spaced apart locations along the bar adjacent each end of the bar, the sharp-ended members extending in the same lateral directions, normal to the longitudinal direction, and lying in a common plane containing the longitudinal direction; and a retainer arrangement on the bar at a fixed location intermediate the sharp-ended members, placed essentially centrally between the first and second ends of the bar, the retainer arrangement being dimensioned and configured for suspending an escape line from the bar, with the escape line juxtaposed with the fixed location;

the longitudinally spaced apart locations being placed on the bar such that upon anchoring the sharp-ended members within the wall with each sharp-ended member placed adjacent a corresponding adjacent window frame member, the bar will be juxtaposed with the corner of the window to locate the retainer arrangement in juxtaposition with the corner for extending the escape line through the window to outside the burning building; and the retainer arrangement including retainers affixed to the bar for confining the escape line to the fixed location.

* * * * *